US005860463A

United States Patent [19]

Lassen

[11] Patent Number: 5,860,463

[45] Date of Patent: Jan. 19, 1999

[54] END STOP DEVICE FOR AN ELECTRICALLY OPERATED WINDOW SCREENING ARRANGEMENT

[75] Inventor: Gert Godvig Lassen, Skjern, Denmark

[73] Assignee: V. Kann Rasmussen Industri A/S, Søborg, Denmark

[21] Appl. No.: 849,952

[22] PCT Filed: Jan. 17, 1996

[86] PCT No.: PCT/DK96/00026

§ 371 Date: Jun. 16, 1997

§ 102(e) Date: Jun. 16, 1997

[87] PCT Pub. No.: WO96/22446

PCT Pub. Date: Jul. 25, 1996

[30] Foreign Application Priority Data

Jan. 18, 1995 [DK] Denmark ..... 0054/95

[51] Int. Cl.[6] ..... E06B 3/94

[52] U.S. Cl. ..... 160/84.02; 160/168.1 P

[58] Field of Search ..... 160/84.02, 168.1 P, 160/310, 265, DIG. 17

[56] References Cited

U.S. PATENT DOCUMENTS

| | | | |
|---|---|---|---|
| 3,603,372 | 9/1971 | Dietzsch | 160/168.1 P |
| 3,809,143 | 5/1974 | Ipekgil | 160/168.1 P |
| 5,178,200 | 1/1993 | Hagen | 160/84.02 X |
| 5,515,898 | 5/1996 | Alcocer | 160/84.02 |

FOREIGN PATENT DOCUMENTS

| | | |
|---|---|---|
| 144894 B | 1/1974 | Denmark . |
| 158054 B | 7/1986 | Denmark . |
| 0040800 | 12/1982 | European Pat. Off. . |
| 0410699 | 1/1991 | European Pat. Off. . |
| 3925695 | 2/1991 | Germany . |

*Primary Examiner*—David M. Purol
*Attorney, Agent, or Firm*—Lane, Aitken & McCann

[57] ABSTRACT

In an electrically operated window screening arrangement, where the movement in one direction between two end positions corresponding to a screened and an unscreened, respectively, window is effected by winding draw cords or strings (3, 4) on at least one winding drum (5, 6) in a horizontal main frame or sash member (7), the winding drum is connected by a motor shaft (8) with an electric drive motor (9). The movement in the opposite direction is carried out by a constant force during simultaneous unwinding of the draw cord or string (3, 4). An end stop device comprises a contact (11) for disruption of the motor current during movement in the opposite direction by activation from a sensor (17). The motor shaft (8) is journalled in such a way that it may perform a limited tilting movement at its connection with the drive motor (9), and the sensor comprises a contact member (17) belonging to the contact (11) and in abutment against a shaft part (8) positioned farthest away from the motor (9), the shaft (8) being spring-biassed in the opposite direction of the load produced by the draw cords or strings (3, 4).

4 Claims, 2 Drawing Sheets

END STOP DEVICE FOR AN ELECTRICALLY OPERATED WINDOW SCREENING ARRANGEMENT

BACKGROUND OF THE INVENTION

The invention concerns an end stop device for an electrically operated window screening arrangement of the type whose movement in one direction between two end positions corresponding to a screened window and an unscreened window, respectively, is effected by winding draw cords or strings connected with the screening arrangement on at least one winding drum positioned in a horizontal main frame or sash member of the window, said drum being over a motor shaft connected with an electric drive motor, whereas movement in the opposite direction is effected by means of a constant force during simultaneous unwinding of said draw cord or string from the winding drum, which end stop device comprises a contact for disruption of the motor current during movement in said opposite direction by activation from a sensor, the drive motor and said contact and sensor being positioned in or at said main frame or sash member.

DK publication no. 158 054 B discloses an electric drive mechanism for a venetian blind where the electric drive motor is provided on or built into the horizontal top section of the window sash. By hoisting the venetian blind, the motor is disconnected when the bottom rail of the venetian blind stops in the top position by detecting the motor current and activating a reset circuit when the power exceeds a pre-determined value.

For obtaining an end stop when lowering the venetian blind, the disconnection of the power supply to the motor in this known design is effected when the bottom rail reaches its bottom position in the way that a reed contact mounted on the bottom section of the sash is affected by a magnet positioned on the bottom rail of the venetian blind.

In addition to the practical inconvenience consisting in that an electrical wire connection has to be established between the reed contact at or in the sash bottom section and the motor arrangement in the top section of the sash, it is in the known drive mechanism not possible to bring the venetian blind to an automatic stop in the middle position during lowering if the bottom rail meets an obstacle, eg. a pot plant.

Furthermore, this known drive mechanism is not suited for other forms of screening devices as eg. roller blinds where it is the rolling down movement which is motor-driven, whereas the rolling up movement is effected by means of a constant spring force.

From DK publication no. 144 894 B, an electric operating device for a venetian blind is known where limit contacts for stopping the drive motor at both upward and downward movement are mounted in the motor casing built into the top list of the venetian blind, operating means for the contacts being journalled and guided in the motor casing and comprising a pin which protrudes through the motor casing and functions as an abutment for the bottom rail of the venetian blind in the top position and to which a projecting sensor lever is fastened, said lever is affected by the draw cord or string of the venetian blind and activates the contact when the cord or string are slackened at the stop of the bottom rail in the bottom position.

Although this embodiment represents a simplification as to installation, it requires a relatively complicated contact device and is aesthetically less attractive due to the operating members projecting from the motor casing.

SUMMARY OF THE INVENTION

The object of the invention is to provide a further simplified end stop device of the mentioned type where the drive motor and all parts of the end stop device may be built into the very same horizontal section of the window main frame or sash without projecting operating members, and where, in addition, the end stop device is suitable for all kinds of window screening arrangements of the stated type such as venetian blinds, pleated blinds, roller shutters, roller blinds, insect screens etc.

For this purpose, the end stop device according to the invention is characterized in that the motor shaft is journalled in such a way that in a plane substantially parallel with said moving directions, said shaft may perform a limited tilting movement with axis of rotation in or at its connection with the drive motor between an active position for unrolling or rolling up and an inactive position, and that the sensor comprises a contact member belonging to the contact and in abutment against a shaft part situated at a distance from the motor, and the shaft is spring-biassed in the opposite direction of the load on the shaft effected by said draw cords or strings in order to act on the shaft towards said inactive position.

In the device according to the invention, the contact is actuated to disruption of the motor current, eg. by resetting commands to a motor control circuit, and the spring-biassed contact member may tilt the motor shaft to the inactive position by slackening the draw cord or string as the screening arrangement takes the end position in question or meets some obstruction during its movement.

The device according to the invention is distinguished by an extremely simple construction with few single parts which may all be built in a hidden manner into the top section or the bottom section of the window main frame or sash depending on the used form of screening device.

BRIEF DESCRIPTION OF THE DRAWING

In the following the invention is explained in detail under reference the schematical drawing, in which.

DETAILED DESCRIPTION OF THE PREFERRED EMBODIMENTS

Figures 1, 2, 3, 4:
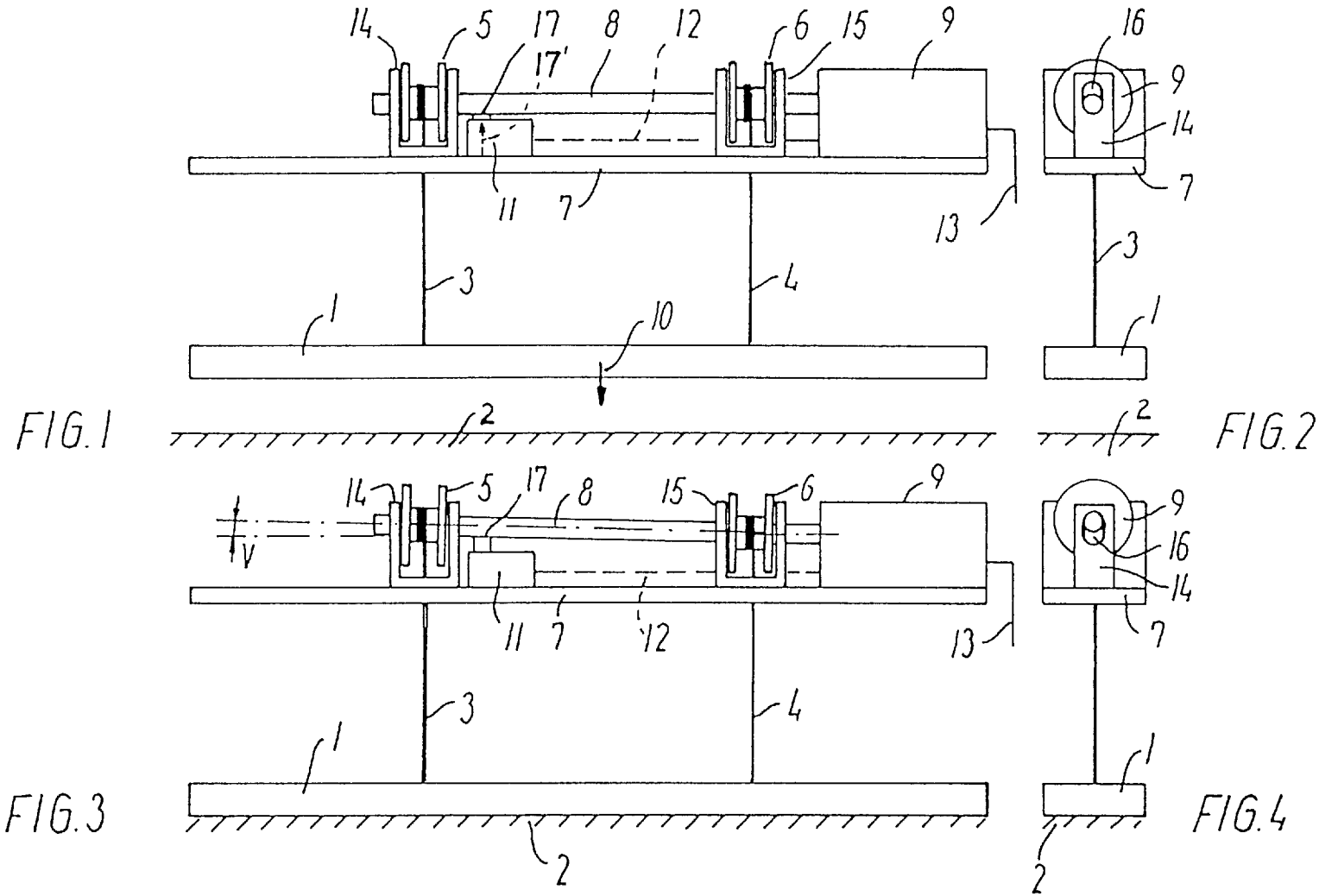
FIGS. 1 and 2 show a front and a side view, respectively, of an embodiment of a screening arrangement such as a pleated fold or a venetian blind, actuated by a downward power, e.g. the gravitational force, incorporating the end stop device according to the invention and shown in an intermediate position.
FIGS. 3 and 4 are front and side views corresponding to FIGS. 1 and 2, respectively, of the same embodiment, with the screening arrangement in a lowered end position corresponding to a screened window.

In the embodiment shown in FIGS. 1–4, a window screening arrangement in the form of eg. a venetian blind or a pleated blind is schematically represented by a bottom rail 1 which, as shown in FIG. 3, in the fully lowered end position of the screening arrangement where the window is screened, abuts against a lower horizontal main frame or sash member 2 in the window. The screening arrangement 1 is suspended in draw cords or strings 3 and 4 which in one end are fastened to the bottom rail 1 and in the opposite upper end are wound on winding drums 5 and 6 which are built into an upper horizontal main frame or sash member schematically represented by its wall 7 facing downwards.

The winding drums 5 and 6 are via a common motor shaft 8 in driving connection with an electrical drive motor 9 also built into the main frame or sash member 7.

In the shown embodiment, the lowering of the screening arrangement is effected in the direction shown by the arrow 10 in FIG. 1 by a downward force which may in particular be the gravitational force perhaps assisted by a spring force or another force influence during simultaneous dewinding of the cords 3 and 4 from the drums 5 and 6 whereas hoisting or raising of the screening device is carried out merely by means of the motor 9 against said forces.

While the disruption of the motor current in fully hoisted position, where the bottom rail 1 is in abutment against the main frame or sash member 7, may typically be effected by detection of the motor current and activation of a reset circuit when exceeding a predetermined value such as known per se, from before-mentioned DK publication no. 158 054 B, the motor current is disrupted during lowering of the screening arrangement towards the end position shown in FIG. 3 and where the bottom rail 1 abuts against the lower main frame or sash member 2, by means of an end stop device comprising a contact 11 eg. in the form of a micro-switch which via a cable connection 12 acts on a non-shown control circuit for the motor 9, which is supplied with power via a cable connection 13.

When the bottom rail 1 reaches the end position shown in FIG. 3 in abutment against the lower main frame or sash member 2 or meets another obstacle, eg. a pot plant, during lowering of the screening arrangement, the contact 11 is activated by a sensor, member as explained in the following, and thus interrupts the motor current.

The winding drums 5 and 6 and the motor shaft 8 are in the shown embodiment journalled in bearing brackets 14 and 15 which as shown in FIGS. 3 and 4 are designed with a slot 16 for the motor shaft 8.

The motor shaft 8 is according to the invention journalled in such a way that in a plane substantially parallel with the moving direction for lowering and raising of the screening device, ie. the plane of the drawing, it is permitted to perform a tilting movement through an angular range v about the connection of the motor shaft 8 with the drive motor 9, said movement being limited by the extension of the slot 16.

The motor shaft 8 may thus be brought from the active position shown in FIG. 1 for dewinding and winding of the the draw cords 3 and 4 to the inactive position shown in FIG. 3. In the illustrated embodiment, the tilting movement is activated by engagement of a sensor member 17 acting on contact 11 against a part of the shaft 8 positioned at a distance from the motor 9, eg. at the bearing bracket 14 positioned farthest from the motor 9. In the shown embodiment, the sensor member 17 itself is spring-biassed to produce a spring force on the shaft 8 in the direction or arrow 17', i.e. opposite to the direction of the load acting on the motor shaft and originating from the draw cords 3 and 4. This spring force may, however, also be produced by a separate, perhaps adjustable spring positioned under the shaft 8.

When during lowering of the screening arrangement, the bottom rail 1 comes to a stop against the lower main frame or sash member 2 or meets another obstruction, the cords 3 and 4 will be slackened so that their load on the motor shaft 8 will be reduced or cease, whereby the motor shaft 8 is tilted to the position shown in FIG. 3 by the spring-bias acting on it, whereby the sensor member 17 will act on contract 11 to disrupt the motor current.

Figure 5:
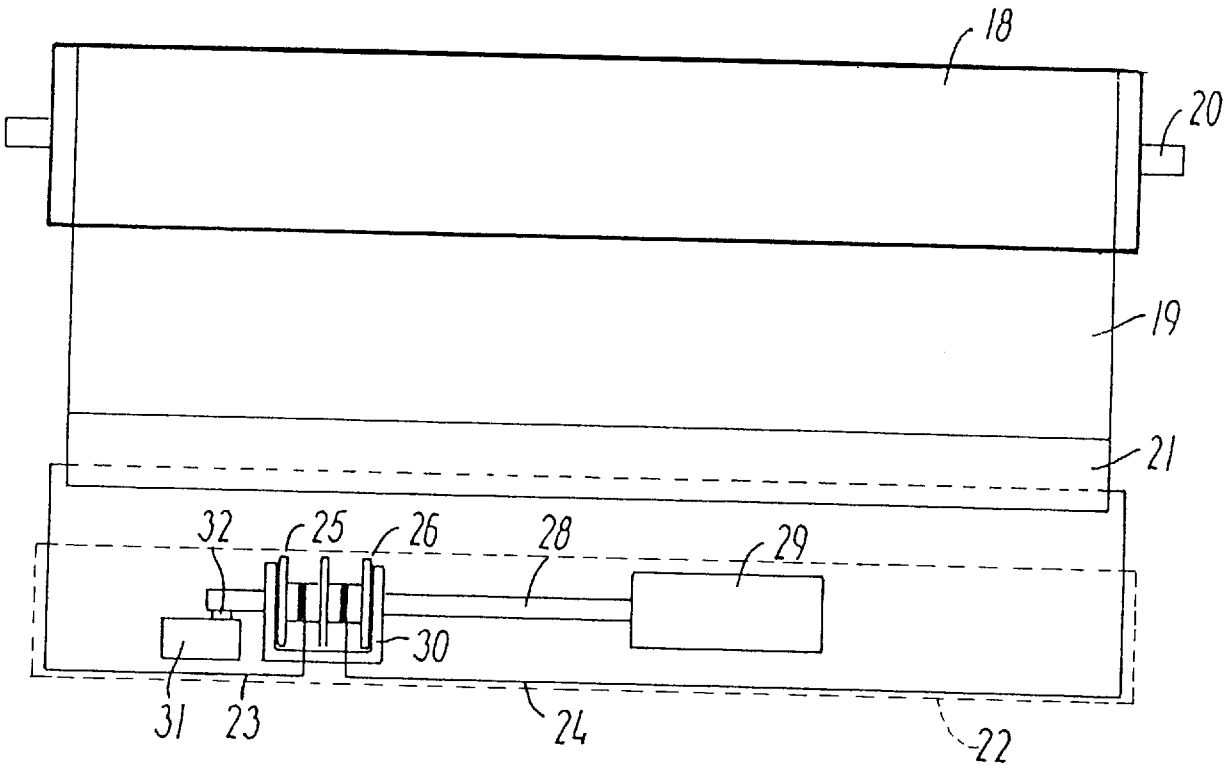
FIG. 5 shows an embodiment of a spring-biassed screening arrangement such as a roller blind incorporating the end stop device of the invention.

As shown in FIG. 5, the invention may also be applied in connection with a screening arrangement 18, eg. a roller blind or a roller shutter, of the type where a flexible screening breadth 19, eg. a roller blind cloth or a set of slats in a roller shutter, is wound up on a spring-biassed roller 20 such that the rolling up movement is carried out by a constant spring force.

The rolling down is effected by means of an electrical drive device positioned in a lower main frame or sash member 22 which device in principle is designed in the same way as shown in FIGS. 1–4 with two winding drums 25 and 26 for draw cords 23 and 24 which in the shown embodiment form one cord lead through the bottom rail 21 in order to secure a parallelism. The drums 25 and 26 are over the motor shaft 28 connected with the drive motor 29. The drums 25 and 26 and the motor shaft 28 are in the shown embodiment journalled in a common bearing bracket 30 with not-shown slots parallel with the direction of the cord force for the motor shaft. The motor shaft may, by a spring-biassed contact member 32 in the end stop contact 31 or another perhaps adjustable spring positioned under the shaft, be made to perform a tilting movement in the same way as described above, however, in this case, by tightening the cords 23 and 24.

I claim:

1. An end stop device for an electrically operated window screening arrangement, which is movable in a plane between two end positions corresponding to a screened and an unscreened window, respectively, the movement of the screening arrangement towards one of said end positions being effected by winding draw cords or strings (3, 4; 23, 24) connected with the screening arrangement on at least one winding drum (5, 6; 25, 26) positioned in a horizontal main frame or sash member (7, 22) of the window, said drum being connected via a motor shaft (8, 28) with an electric drive motor (9, 29), wherein movement of the screening arrangement towards the other end position is effected by a constant force during simultaneous unwinding of said draw cords or strings (3, 4; 23, 24) from the winding drum (5, 6; 25, 26), said end stop device comprising a contact (11, 31) for disruption of the motor current during movement towards said other end position in response to activation from a sensor member (17, 32), the drive motor (9, 29), said contact (11) and said sensor member being arranged at said main frame or sash member (7, 22), characterized in that the motor shaft (8, 28) is journalled in bearing members (14, 15) in a way to permit said shaft to perform a limited tilting movement in said plane about its connection with the drive motor (9, 29) between an active position for unwinding or winding of said draw cords or strings and an inactive position, and that said sensor member (17,32) is arranged to engage a part of said motor shaft (8,28) situated at a distance from the motor (9,29), said motor shaft (8, 28) being biassed by spring means in the direction towards said inactive position and opposite to the direction of the load on the shaft (8, 28) effected by said draw cords or strings (3, 4; 23, 24).

2. An end stop device according to claim 1, characterized in that said spring means acts on said sensor member (17, 32).

3. An end stop device according to claim 1, wherein the movement of said screening arrangement towards the end position corresponding to a screened window is effected by a downward force, characterized in that the winding drum (5, 6), the drive motor (9) with accompanying motor shaft (8), said contact (11) and said sensor member (17) are arranged in an upper main frame or sash member (7) for the window.

4. An end stop device according to claim 1, wherein the movement of said screening arrangement towards the end position corresponding to an unscreened window is effected by a spring force, characterized in that the winding drum (25, 26), the drive motor (29) with the motor shaft (28), said contact (31) and said sensor member (32) are arranged in a lower main frame or sash member (22) of the window.

* * * * *